US005542881A

United States Patent [19]

Geib

[11] Patent Number: 5,542,881

[45] Date of Patent: Aug. 6, 1996

[54] COIN SORTING MECHANISM HAVING DUAL RECYCLE CHANNELS

[75] Inventor: Joseph J. Geib, Mount Prospect, Ill.

[73] Assignee: Cummins-Allison Corp., Mt. Prospect, Ill.

[21] Appl. No.: 430,411

[22] Filed: Apr. 28, 1995

[51] Int. Cl.[6] ..... G07D 3/06

[52] U.S. Cl. ..... 453/10

[58] Field of Search ..... 453/9, 10, 12, 453/49, 57

[56] References Cited

U.S. PATENT DOCUMENTS

| | | | |
|---|---|---|---|
| 4,444,212 | 4/1984 | Ristvedt et al. . | |
| 4,531,531 | 7/1985 | Johnson et al. . | |
| 4,543,969 | 10/1985 | Rsmussen . | |
| 4,549,561 | 10/1985 | Johnson et al. . | |
| 4,564,036 | 1/1986 | Ristvedt . | |
| 4,564,037 | 1/1986 | Childers et al. . | |
| 4,570,655 | 2/1986 | Raterman . | |
| 4,607,649 | 8/1986 | Taipale et al. . | |
| 4,731,043 | 3/1988 | Ristvedt et al. . | |
| 4,775,354 | 10/1988 | Rasmussen et al. . | |
| 5,106,338 | 4/1992 | Rasmussen et al. | 453/10 |
| 5,163,866 | 11/1992 | Rasmussen | 453/10 |
| 5,163,867 | 11/1992 | Rasmussen | 453/10 |
| 5,209,696 | 5/1993 | Rasmussen et al. | 453/12 X |

*Primary Examiner*—Karen B. Merritt
*Assistant Examiner*—Scott L. Lowe
*Attorney, Agent, or Firm*—Arnold, White & Durkee

[57] ABSTRACT

A disc-type coin sorter comprises a rotatable disc with a resilient top surface. A stationary sorting head forms a queuing region to align the outer edges of the coins at a desired common radius, and a plurality of exit channels receive the queued coins and guide coins of different diameters to different exit stations along the periphery of the sorting head. The lower surface of the sorting head is positioned parallel to the upper surface of the disc and spaced slightly therefrom, to press coins of all denominations downwardly into the resilient top surface at predetermined sections thereof. A pair of recycle channels recirculates coins in the queuing region if the outer edges of these coins are located inwardly of the desired common radius.

4 Claims, 3 Drawing Sheets

COIN SORTING MECHANISM HAVING DUAL RECYCLE CHANNELS

FIELD OF THE INVENTION

The present invention relates generally to coin sorting devices and, more particularly, to coin sorters of the type which use a resilient rotating disc and a stationary sorting head for sorting coins of mixed denominations.

BACKGROUND OF THE INVENTION

In coin sorters of the foregoing type, coins are carried on a resilient disc rotating beneath a stationary sorting head which manipulates the coins through queuing, sorting and ejection movements. In most such sorters the coins are all initially queued so that the outer edges of coins of all denominations are located at a common radial position, relative to the center of rotation of the disc. This causes the inner edges of coins of different denominations to be located at different radial positions determined by the coin denomination (diameter), which are used to sort the coins.

To avoid missorting of coins that are not properly queued, it is typical to provide a recycle channel between the queuing region and the sorting region of the sorting head. This recycle channel intercepts the coins that are improperly queued and returns them to the entry region of the sorting head for re-queuing. It has been found, however, that certain coin combinations can bypass the recycle channel and still cause missorts. For example, a small thin coin following a large thick coin may pass beneath the recycle channel because the small coin rests on a portion of the surface of the resilient disc that is depressed by the large coin. Also, certain conditions can cause the recycle channel to become "flooded" with coins, so that certain of the improperly queued coins ride over other coins already in the recycle channel.

SUMMARY OF THE INVENTION

Accordingly, an object of the present invention is to provide a coin sorter which minimizes missorting by ensuring that coins which are improperly gaged during queuing are recycled so that such coins do not enter the sorting region.

Other objects and advantages of the invention will become apparent upon reading the following detailed description and upon reference to the accompanying drawings.

In accordance with the present invention, the foregoing objectives are realized by providing a disc-type coin sorter comprising a rotatable disc having a resilient top surface and a stationary sorting head having a lower surface positioned parallel to the upper surface of the disc and spaced slightly therefrom. The lower surface of the sorting head forms a queuing region for aligning the outer edges of the coins at a common radius, and a plurality of exit channels for receiving the queued coins and guiding coins of different diameters to different exit stations along the periphery of the sorting head. A pair of adjacent and substantially parallel recycle channels are provided between the queuing region and the exit channels for recirculating coins whose outer edges are located inwardly of the desired common radius.

DETAILED DESCRIPTION OF THE PREFERRED EMBODIMENT

Figure 1:
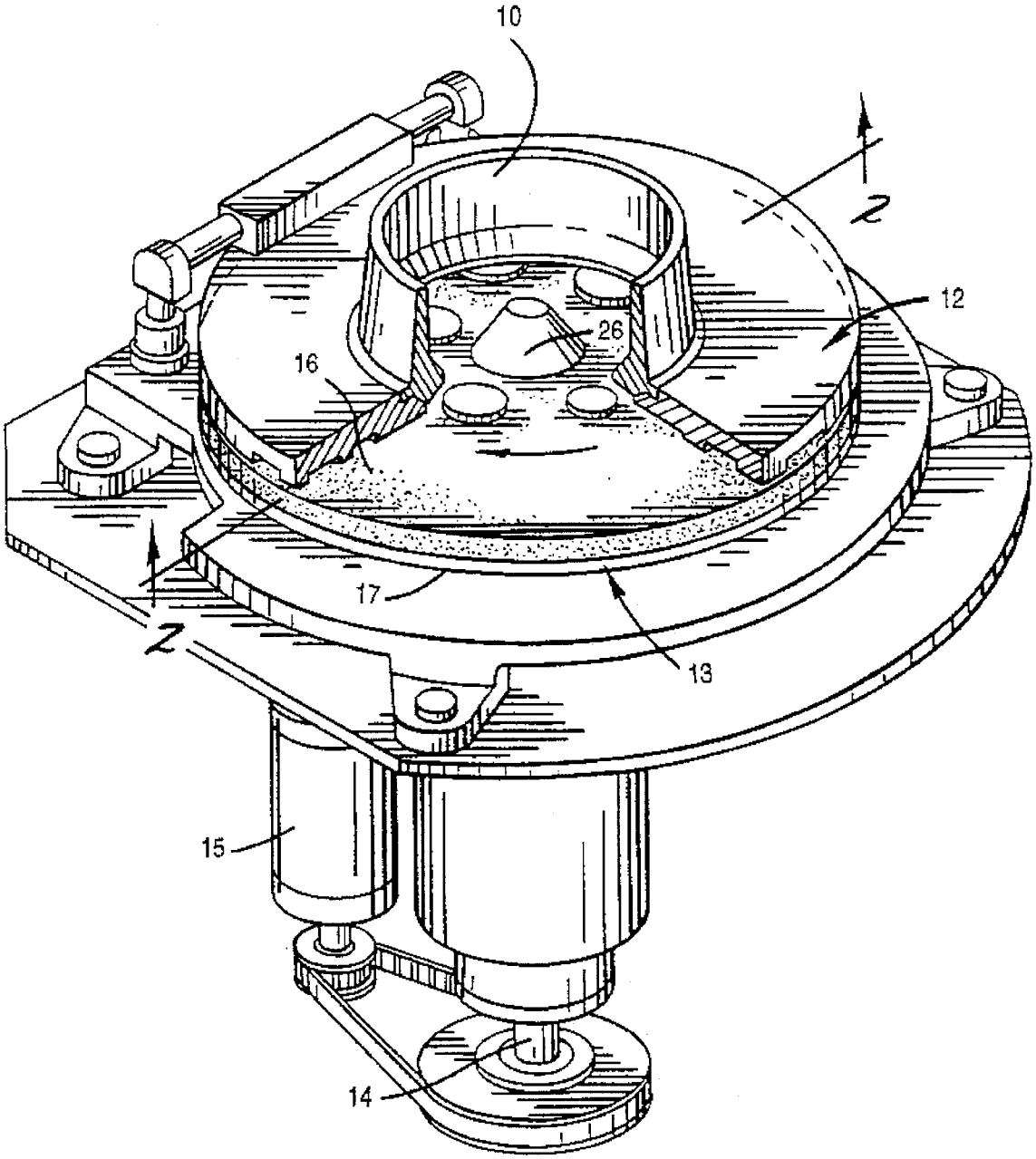
FIG. 1 is a perspective view of a coin sorter embodying the present invention, with a top portion thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a feed opening 11 in an annular sorting head or guide plate 12. As the coins pass through the feed opening, they are deposited on the top surface of a rotatable disc 13. This disc 13 is mounted for rotation on a stub shaft 14 and driven by an electric motor 15 mounted to a base plate. The disc 13 comprises a resilient pad 16 bonded to the top surface of a solid metal disc 17. The top surface of the resilient pad 16 is preferably spaced from the lowermost surface of the sorting head 12 by a gap that is slightly less than the thickness of the thinnest coin.

As the disc 13 is rotated, the coins deposited on the top surface thereof tend to slide outwardly over the surface of the pad due to centrifugal force. The coins are initially displaced from the center of the disc 13 by a cone 26, and therefore are subjected to sufficient centrifugal force to overcome their static friction with the upper surface of the disc. As the coins move outwardly, those coins which are lying flat on the pad enter a crescent-shaped entry region 31 between the pad surface and the sorting head 12 because the underside of the head in this entry region is spaced above the pad 16 by a distance which is about the same as the thickness of the thickest coin. As further described below, the coins are then queued and sorted into their respective denominations, and the coins for each denomination issue from a respective exit channel, such as the channels 20, 21, 22, 23, 24 and 25 (FIG. 2) for dimes, pennies, nickels, quarters, dollars, and half-dollars, respectively.

In general, the coins for any given currency are sorted by the variation in diameter of the various denominations. Prior to sorting, the coins are manipulated between the sorting head and the rotating disc to queue the coins into a single-file, single-layer stream of coins. The outer edges of all the coins in this stream of coins are normally aligned to be tangent to a common line of travel so that the downstream edges of the coins can be engaged to discriminate among coins of different diameters, directing the coins to the exit channels for the respective denominations.

Figure 2:
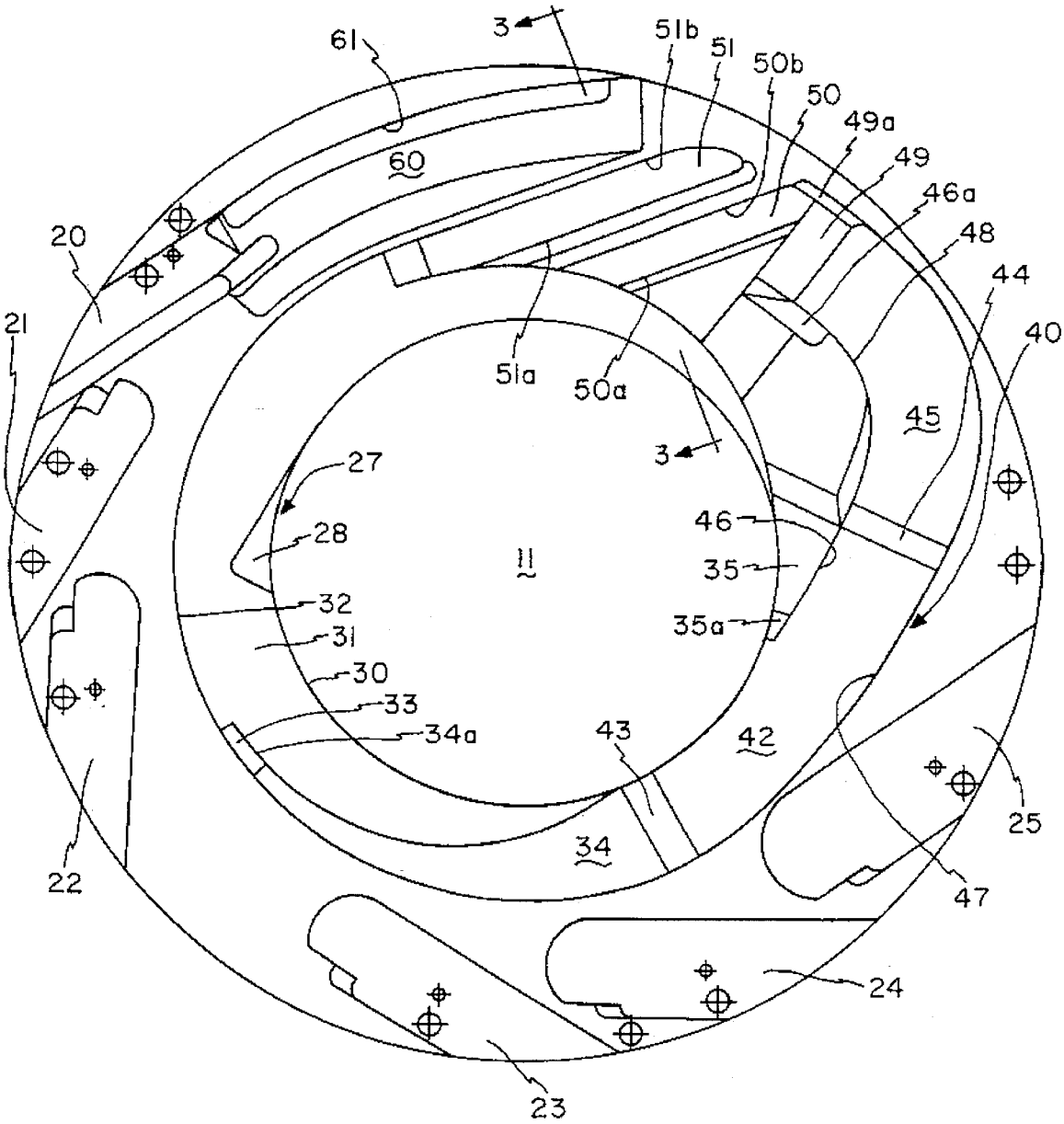
FIG. 2 is an enlarged horizontal section taken generally along line 2—2 in FIG. 1.

Turning now to FIG. 2, there is shown a bottom view of the preferred sorting head 12 including various channels and other means especially designed for high-speed sorting with positive control of the coins. It should be kept in mind that the circulation of the coins, which is clockwise in FIG. 1, appears counterclockwise in FIG. 2 because FIG. 2 is a bottom view. The various regions that manipulate the coins include the entry region 31 adjacent the inner periphery 30 of the sorting head, a queuing region which includes a spiral channel 40, and the exit channels 20–25 for different coin denominations.

Considering first the entry region 31, the coins deposited on the rotating disc 13 directly beneath the feed opening 11 are carried under the inner periphery 30 of the sorting head into the crescent-shaped recess 31 adjacent the inner periphery 30. Coins can move radially across the recess 31, as they are carded in the circumferential direction by the rotating movement of the disc 13. Radial outward movement of coins within the recess 31 is terminated when they engage the outer wall 32, though the coins continue to be moved circumferentially along the wall 32 by the rotational movement of the disc 13. The outer wall 32 of the recess 31 extends down to the lowermost surface of the sorting head 12, which is preferably spaced from the top surface of the pad 16 by a distance, e.g., 0.005 inch, which is less than the thickness of the thinnest coin.

To prevent the entry region 31 from becoming blocked by shingled coins, a tapered notch 27 near the inner periphery 30 of the sorting head forms a wall or step 28 for engaging the uppermost coin in a shingled pair so that the upper coin is forced off the lower coin as the lower coin is moved by the rotating disc 13.

As the disc 13 rotates, thick coins in the recess 31 that are next to the wall 32 engage a ramp 33 which presses the coins into the pad 16; thereafter their radial position is fixed by pressure between the pad 16 and a surface 34. Thick coins which fail to initially engage the ramp 33, engage a wall **34*a* along the inner edge of the ramp 33 and the surface 34 and are recirculated back into the feed opening of the sorting head. This prevents misaligned thick coins from hindering the flow of coins to the spiral channel 40**.

A portion of the feed opening of the sorting head 12 which does not open directly into the recess 31 is occupied by a land 35 whose lower surface is at a higher elevation than the lowermost surface of the sorting head. The upstream end of the land 35 forms a ramp **35*a* (FIG. 2). When a coin is only partially past the inner periphery 30, when the coin encounters the land 35, the coin engages the ramp 35*a* on the leading edge of the land 35. The ramp 35*a* presses the coin downwardly into the resilient pad 16**, which causes the coin to be recirculated.

Coins which clear the ramp **35*a* enter the spiral channel 40 which guides the coins toward the outer edge of the sorting head. Coins of all denominations exit the spiral channel 40 with a common edge (the outer edges of all coins) aligned at the same or approximately the same radial position so that the opposite (inner) edges of the coins can be used for sorting. A recycling channel 50 is provided near the outlet of the spiral channel 40, for recycling coins which do not have their outer edges close to the desired final radial position at the end of the channel 40**.

The illustrative spiral channel 40 also strips apart stacked or shingled coins. Thus, region 42 within the spiral channel is at a higher elevation than the rest of the channel, e.g, surface 45. In general, the combined thickness of a pair of stacked or shingled coins is great enough to cause the lower coin in that pair to be pressed into the resilient pad 16 as the pair of coins traverses the region 42 and its entry and exit ramps 43 and 44, respectively. Consequently, that pair of coins will be rotated concentrically with the disc until the upper coin engages the inner wall 46, and the lower coin passes under the land 35. The latter coin will be recirculated back to the entry region of the sorting head and will later re-enter the spiral channel.

The central portion 42 of the spiral channel is sufficiently deep to allow relatively thin coins to be guided along an outer wall 47 by centrifugal force, but sufficiently shallow to permit relatively thick coins to be pressed between the pad 16 and the sorting head so that they are guided along the inner wall 46 as they move through the channel 40.

The end portion 45 of the channel 40 bends such that coins which are sufficiently thick to be guided by the inner wall 46 but have a width which is less than the width of the channel 40, are carried away from the inner wall 46 from a maximum radial location 48 on the inner wall toward a ramp 49. This configuration allows the coins of all denominations to converge at a narrow ramped finger **49*a* at the outer edge of the ramp 49, with coins having the largest diameter being carried between the inner and outer walls to the ramped finger 49*a* so as to bring the outer edges of all coins to a common radial location. By directing smaller and thinner coins radially inwardly along the latter portion of the outer wall 47, the probability of coins being offset from the outer wall 47 by adjacent coins is significantly reduced. Any coins which are only slightly offset from the outer wall 47 and thus still engage the ramp finger 49*a* are accommodated by locating the outer edge of the final gaging recess 60 radially inwardly from the outer edge of the ramped finger 49*a***.

All coins which are close enough to the outer wall 47 to be engaged by the narrow ramped finger **49*a* are carded forward to the final gaging recess 60. If a coin is not sufficiently close to the wall 47 to be engaged by this ramped finger 49*a*, then the coin is captured by the recycle channel 50, and that coin is recirculated back to the entry region 31. The recycling of coins of relatively large diameter is facilitated by a bevelled wall 46*a* adjacent the downstream end of the vertical wall 46**.

Coins which are properly gaged at the end of the wall 47 do not enter the recycle channel and are carded into the final gaging recess 60 which forms a final gaging wall 61. At least the initial portion of the gaging wall 61 is along a spiral path with respect to the center of the sorting head 12 and the sorting disc 13, so that as the coins are positively driven in the circumferential direction by the rotating disc 13, the outer edges of the coins engage the gaging wall 61 and are forced radially inwardly to a precise gaging radius.

It has been found that the recycle channel 50 is not capable of removing all the improperly gaged coins when used with certain coin sets, such as the Dutch coin set. The Dutch coin set has a large thick coin and a small thin coin, and when the latter follows the former through the queuing region, the depression formed by the large coin in the resilient pad can lower the elevation of the smaller coin and cause it to pass beneath the recycle channel without engaging the downstream wall of that channel. Consequently, the small coin is carried into the sorting region and causes a missort. With certain coin mixes, it is also possible for the recycle channel to become "flooded" with improperly gaged coins, in part because coins can move outwardly through the queuing channel 40 faster than coins can move inwardly through the recycle channel 50. Such "flooding" of the recycle channel causes some of those coins to be passed on to the sorting region, again causing missorts.

In accordance with one important aspect of the present invention, a second recycle channel 51 is provided adjacent to, and substantially parallel with, the first channel 50. Both recycle channels 50 and 51 have their outer ends spaced radially inwardly from the final radius of the gaging wall 47 by the width of the ramped finger **49*a***. For reasons which are not completely understood, it has been found that the second recycle channel captures coins that miss the first recycle channel. Even small thin coins that miss the first channel because they are closely following a large thick coin, are captured in the second recycle channel, even though the small coin still follows the thick coin as they traverse the second channel.

Figure 3:
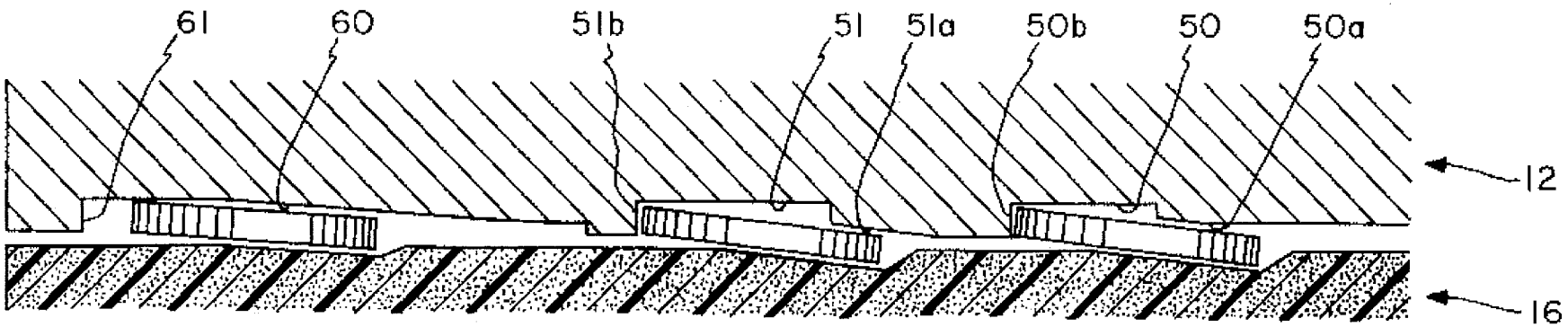
FIG. 3 is an enlarged section taken generally along line 3—3 in FIG. 2.

As can be seen in FIG. 3, the cross-sectional profiles of the two recycle channels 50 and 51 are similar, except that the second channel 51 is wider than the first channel 50. Specifically, each channel has a tapered upstream edge to form a narrow ramp 50*a* or 51*a* to facilitate the tilting of coins of varying diameters that are captured in the recycle channel because of improper queuing. This tilting of the coins ensures secure engagement of the leading edges of the intercepted coins with the vertical downstream edge 50*b* or 51*b* of the recycle channel in which it is captured. Coins captured by either of the channels 50 and 51 are guided inwardly to the entry region 31 by the respective downstream wall 50*b* or 51*b* as the intercepted coins continue to be driven by the rotating disc.

The sorting head 12 further includes a sorting region that includes the series of exit channels 20–25 spaced circumferentially around the outer periphery of the plate, with the innermost edges of successive channels located progressively farther away from the common radial location of the outer edges of all the coins for receiving and ejecting coins in order of increasing diameter. The width of the entry end of each exit channel is preferably smaller than the diameter of the coin to be received and ejected by that particular channel, and the surface of the sorting head adjacent the radially outer edge of each exit channel presses the outer portions of the coins received by that channel into the resilient pad so that the inner edges of those coins are tilted upwardly into the channel. The exit channels extend outwardly to the periphery of the sorting head so that the inner edges of these channels guide the tilted coins outwardly and eventually eject those coins from between the sorting head 12 and the resilient pad 16.

The innermost edges of the exit channels are positioned so that the inner edge of a coin of only one particular denomination can enter each channel; the coins of all other remaining denominations extend inwardly beyond the innermost edge of that particular channel so that the inner edges of those coins cannot enter the channel.

For example, the first exit channel 20 is intended to discharge only dimes, and thus the innermost edge 20*a* of this channel is located at a radius that is spaced inwardly from the radius of the final gaging wall 61 by a distance that is only slightly greater than the diameter of a dime. Consequently, only dimes can enter the channel 20. Because the outer edges of all denominations of coins are located at the same radial position when they leave the final gaging recess 60, the inner edges of the pennies, nickels, quarters, dollars and half dollars all extend inwardly beyond the innermost edge of the channel 20, thereby preventing these coins from entering that particular channel.

At channel 21, the inner edges of only pennies are located close enough to the periphery of the sorting head 12 to enter the channel. The inner edges of all the larger coins extend inwardly beyond the innermost edge 21*a* of the channel 21 so that they remain gripped between the sorting head and the resilient pad. Consequently, all the coins except the pennies continue to be rotated past the channel 21.

Similarly, only nickels enter the exit channel 22, only the quarters enter the channel 23, only the dollars enter the channel 24, and only the half dollars enter the channel 25.

Because each coin is gripped between the sorting head 12 and the resilient pad 16 throughout its movement through the exit channel, the coins are under positive control at all times. Thus, any coin can be stopped at any point along the length of its exit channel, even when the coin is already partially projecting beyond the outer periphery of the sorting head. Consequently, no matter when the rotating disc is stopped (e.g., in response to the counting of a preselected number of coins of a particular denomination), those coins which are already within the various exit channels can be retained within the sorting head until the disc is re-started for the next counting operation.

I claim:

1. A disc-type coin sorter, comprising:

a rotatable disc having a resilient top surface, a stationary sorting head having an outer periphery a lower surface, and an upper surface, said sorting head forming a queuing region which includes an entry area and an outer wall for aligning the outer edges of the coins at a desired common radius, and a plurality of exit channels for receiving the queued coins and guiding coins of different diameters to different exit stations along the outer periphery of the sorting head, the lower surface of said sorting head being positioned parallel to the upper surface of said disc and spaced slightly therefrom, to press coins of all denominations downwardly into said resilient top surface at predetermined sections of said sorting head, and first and second recycle channels within said queuing region for recirculating coins whose outer edges are located inwardly of said desired common radius, said recycle channels being located directly adjacent, and substantially parallel to, each other, both of said recycle channels having radially outer ends and extending inwardly from approximately the same desired common radius, at the end of said outer wall, so that any coins spaced inwardly of said outer wall and not captured by the first recycle channel are captured by the second recycle channel.

2. The coin sorter of claim 1 wherein the radially outer ends of both of said recycle channels are spaced radially inwardly from said desired common radius.

3. The coin sorter of claim 1 wherein said queuing region includes a gaging wall, having an upstream end and a downstream end, for positioning the outer edges of all coins at said desired common radius, and both of said recycle channels are located adjacent the downstream end of said gaging wall.

4. The coin sorter of claim 1 wherein both of said recycle channels extend inwardly to the entry area of said queuing region.

* * * * *